US009090386B2

(12) United States Patent
van Alfen et al.

(10) Patent No.: US 9,090,386 B2
(45) Date of Patent: Jul. 28, 2015

(54) CLOSURE WITH TAMPER-EVIDENT STRIP

(71) Applicant: Plasticum Netherlands B.V., Tilburg (NL)

(72) Inventors: Jan van Alfen, Nijmegen (NL); Shi Ming Pun, Arnhem (NL); Sebastiaan Wilhelmus Josephus den Boer, Twello (NL); Gerrit Jan Stegeman, Lochem (NL)

(73) Assignee: PLASTICUM NETHERLANDS B.V., Tilburg (NL)

( * ) Notice: Subject to any disclaimer, the term of this patent is extended or adjusted under 35 U.S.C. 154(b) by 0 days.

(21) Appl. No.: 14/358,187

(22) PCT Filed: Nov. 13, 2012

(86) PCT No.: PCT/NL2012/050802

§ 371 (c)(1),
(2) Date: May 14, 2014

(87) PCT Pub. No.: WO2013/077732

PCT Pub. Date: May 30, 2013

(65) Prior Publication Data

US 2014/0312038 A1 Oct. 23, 2014

(30) Foreign Application Priority Data

Nov. 22, 2011 (NL) ..... 2007838

(51) Int. Cl.
*B65D 50/00* (2006.01)
*B65D 47/08* (2006.01)

(52) U.S. Cl.
CPC ..... *B65D 50/00* (2013.01); *B65D 47/0804* (2013.01); *B65D 2101/003* (2013.01)

(58) Field of Classification Search
CPC ..... B65D 47/0804; B65D 47/0838; B65D 47/243; B65D 47/36; B65D 49/12; B65D 2101/0023; B65D 2101/003; B65D 2101/0038
USPC ..... 215/224, 235, 237, 250–251, 253–255, 215/263; 220/254.1, 254.3–254.5, 255.1, 220/258.1, 259.1, 265–266, 269–270, 220/FOR. 206; 222/541.1, 541.5–541.6, 222/556
See application file for complete search history.

(56) References Cited

U.S. PATENT DOCUMENTS 4,487,324 A * 12/1984 Ostrowsky ..... 215/253
5,875,907 A * 3/1999 Lay ..... 215/253

(Continued)

FOREIGN PATENT DOCUMENTS

DE 29512523 U1 11/1995
JP 2007-45422 A 2/2007

OTHER PUBLICATIONS

English translation of abstract and claim 1 of DE 29512523 U1.

(Continued)

*Primary Examiner* — Bryon Gehman
*Assistant Examiner* — Brijesh V. Patel
(74) *Attorney, Agent, or Firm* — Hoffmann & Baron, LLP

(57) ABSTRACT

A tamper-evident dispensing closure includes a body adapted to be attached to a container and a pivotable lid which is hingedly attached to the body. A tamper-evident strip is located within the contour of the body and attached to the body by means of predetermined frangible connecting points. The tamper-evident strip is engaged or engageable by at least one locking member provided on a skirt portion of the lid, such that the lid is only pivotable to the open position when the tamper-evident strip is permanently removed. The body and the pivotable lid in the closed position define a recess in which the tamper-evident strip is received in a countersunk manner. The recess has a height which essentially corresponds to the height of the tamper evident strip such that the edges of the tamper-evident strip are essentially unreachable.

15 Claims, 3 Drawing Sheets

(56) References Cited

U.S. PATENT DOCUMENTS

| | | | | |
|---|---|---|---|---|
| 6,321,923 | B1 * | 11/2001 | Wood | 215/235 |
| 6,631,820 | B2 * | 10/2003 | Harrold et al. | 215/237 |
| D672,654 | S * | 12/2012 | Jackel | D9/449 |
| D711,231 | S * | 8/2014 | Pun | D9/449 |
| D713,724 | S * | 9/2014 | den Boer | D9/449 |
| 2004/0069806 | A1 | 4/2004 | Benoit-Gonin et al. | |
| 2004/0188374 | A1 * | 9/2004 | Ochoa Laburu | 215/235 |
| 2005/0279727 | A1 * | 12/2005 | Graswald et al. | 215/237 |
| 2006/0043052 | A1 * | 3/2006 | Lin | 215/253 |
| 2006/0186077 | A1 * | 8/2006 | Robinson | 215/237 |
| 2006/0249474 | A1 * | 11/2006 | Sawyer et al. | 215/256 |
| 2008/0169261 | A1 * | 7/2008 | Druitt et al. | 215/237 |
| 2008/0257852 | A1 * | 10/2008 | Herald et al. | 215/237 |
| 2009/0152269 | A1 * | 6/2009 | Pucci | 220/254.3 |
| 2009/0314792 | A1 | 12/2009 | Lenz et al. | |

OTHER PUBLICATIONS

Patent abstract of JP 2007-45422 A.

* cited by examiner

CLOSURE WITH TAMPER-EVIDENT STRIP

CROSS-REFERENCE TO RELATED APPLICATIONS

This application is the National Stage of International Application No. PCT/NL2012/050802 filed Nov. 13, 2012, which claims the benefit of Netherlands Application No. NL 2007838, filed Nov. 22, 2011, the contents of which is incorporated by reference herein.

BACKGROUND OF THE INVENTION

The invention relates to a tamper-evident dispensing closure comprising:

a body adapted to be attached to a container, said body having a peripheral wall and a top wall which extends over one end of the peripheral wall, such that the corresponding end of the body is closed off by the top wall and an opposite end of the body is open, said top wall being provided with a dispensing passage;

a pivotable lid, which is hingedly attached to the body, said lid being pivotable between a closed position, in which the lid is positioned over said dispensing passage, and an open position, in which it is spaced apart from said dispensing passage, the lid having a cover wall and at least one skirt portion that extends from the cover wall, such that in the closed position of the pivotable lid, the cover wall is substantially parallel to the top wall of the body and the skirt portion engages the top wall of the body with its end remote from the cover wall;

a tamper-evident strip located within the contour of the body and attached to the body by means of predetermined frangible connecting points, said tamper-evident strip being engaged or engageable by at least one locking member provided on said skirt portion of the lid, such that the lid is only pivotable to the open position when the tamper-evident strip is permanently removed by breaking the frangible connecting points, wherein the body and the pivotable lid in the closed position define a recess in which the tamper-evident strip is received in a countersunk manner, said recess having an outer contour being defined on an upper side by the cover wall of the lid and on an lower side by the top wall of the body, and on lateral side ends by lateral wall portions adjoining the top wall of the body or the cover wall of the lid.

A closure of this type is disclosed in DE 295 12 523. In this prior art closure the recess is formed by a recessed portion of the skirt of the lid. The recess has a greater length in the circumferential direction than the tamper-evident strip, such that one or both of the end portions of the tamper-evident strip can be grabbed by the fingers of a hand to tear the tamper-evident strip from the closure. The strip is removed before the first-time opening of the lid with a tearing movement along the length direction of the strip, during which the connection points are broken one by one. A disadvantage of the known tamper-evident strip is that it can be swiveled forward, with the connection points as pivoting points. When the strip is swiveled forwards the locking members could be disengaged from the strip, which would create the possibility to open the lid of the closure without removing the tamper-evident strip.

The present invention has for an object to provide a more effective tamper-evident closure.

SUMMARY OF THE INVENTION

This object is achieved by a tamper-evident closure as described at the outset, wherein the recess has a height which essentially corresponds to the height of the tamper evident strip, and has a length that corresponds essentially to the length of the tamper-evident strip whereby only a small gap between the outer contour of the recess and the tamper-evident strip is present, such that the edges of the tamper-evident strip are essentially unreachable, and wherein the body is provided with an indent, which adjoins the recess, and which allows a user to engage the tamper-evident strip from below with a finger so as to pull the tamper-evident strip and the pivotable lid up in one movement, during a first-time opening of the closure.

The tamper-evident closure according to the invention has a tamper-evident strip that is torn off simultaneously with the first-time opening of the closure. The tearing movement is in the height direction of the strip.

The tamper-evident strip according to the invention cannot be swiveled forward, because the end portions and the upper edge of the tamper-evident strip are unreachable. The strip can only be engaged from below, thus from the same side where the frangible connections are arranged, hence preventing that the strip can be subjected to a swiveling movement. Thus a more secure and reliable tamper-evident closure is provided.

In a possible embodiment the tamper-evident strip has end portions which are bent inwards. This allows that the ends of the strip at the front surface thereof have a rounded shape which hampers grabbing the end or sticking a thin object between the edge of the recess and the edge of the strip which could be used as a lever to swivel the strip forward.

In a possible embodiment at least at each of said end portions of the strip a frangible connection point is arranged. This feature prevents that the strip can be swiveled with the connection points as hinge. This feature is especially effective when the tamper-evident strip is straight or has a great radius of curvature, e.g. at the front of generally oval closures. In those cases the frangible connection points would be located more or less in a straight line which allows a pivoting movement around the connection points. By locating the outer connection points behind that straight line, by arranging them at the inwardly bent end tips of the strip, the possibility to swivel the strip forward is inhibited, unless the outer connection points are ruptured.

In a possible embodiment the cover wall of the lid engages the upper edge of the tamper-evident strip. This prevents that some thin object can be pushed in between the upper edge of the tamper-evident strip and the cover wall of the lid in an attempt to swivel the strip forward.

In another possible embodiment the tamper-evident strip is attached to the body by two pairs of frangible connection points, wherein between the frangible connection points of each pair a locking member engages the lower edge of the tamper-evident strip. In this embodiment the tamper-evident strip may be provided with a cutout between the frangible connection points of each pair for receiving said locking member.

In a possible embodiment the recess is mainly formed in the pivotable lid, as an indent in the skirt portion of the lid.

In a possible embodiment the skirt portion of the lid is a skirt with a closed contour, wherein, preferably in the closed position of the lid, the skirt of the lid and the peripheral wall of the body are flush with each other, except at the location of the recess. The tamper-evident strip may have a front surface which lies flush with the skirt of the lid and the peripheral wall of the body.

Preferably the closure according to the invention is manufactured in one piece by injection moulding. The body, the lid, the hinge(s) connecting the body and the lid, and the tamper-evident strip are formed in one piece.

In a possible embodiment the outer contour of the peripheral wall is curved, e.g. circular or elliptical, and wherein the tamper-evident strip extends along the contour about an angle of less than 180°, preferably less than 90°.

The invention will be described in more detail in the following description with reference to the drawing.

DETAILED DESCRIPTION

Figure 1:
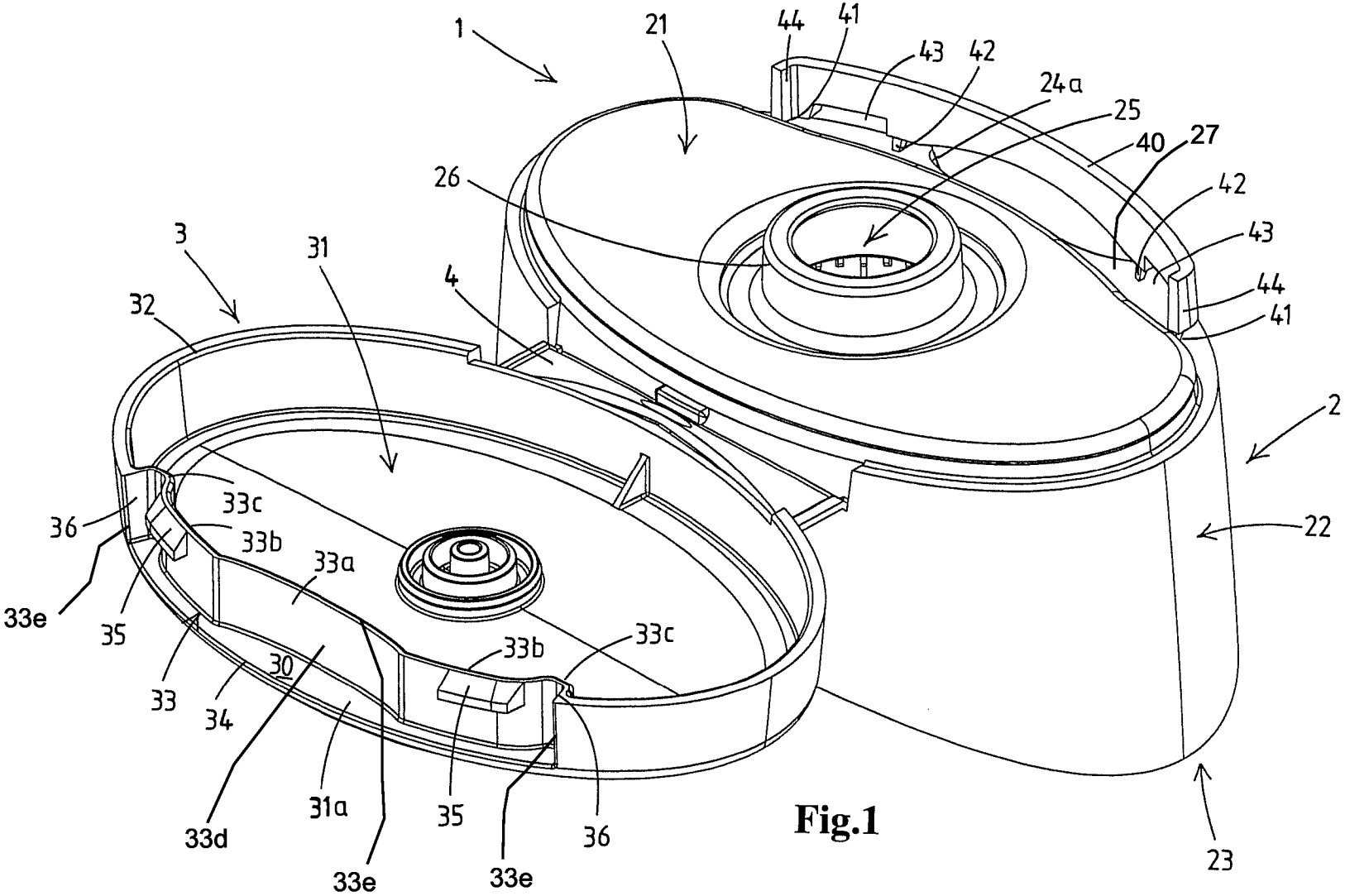
FIG. 1 shows in a view in perspective a preferred embodiment of closure according to the invention in an open state.
Figure 2:
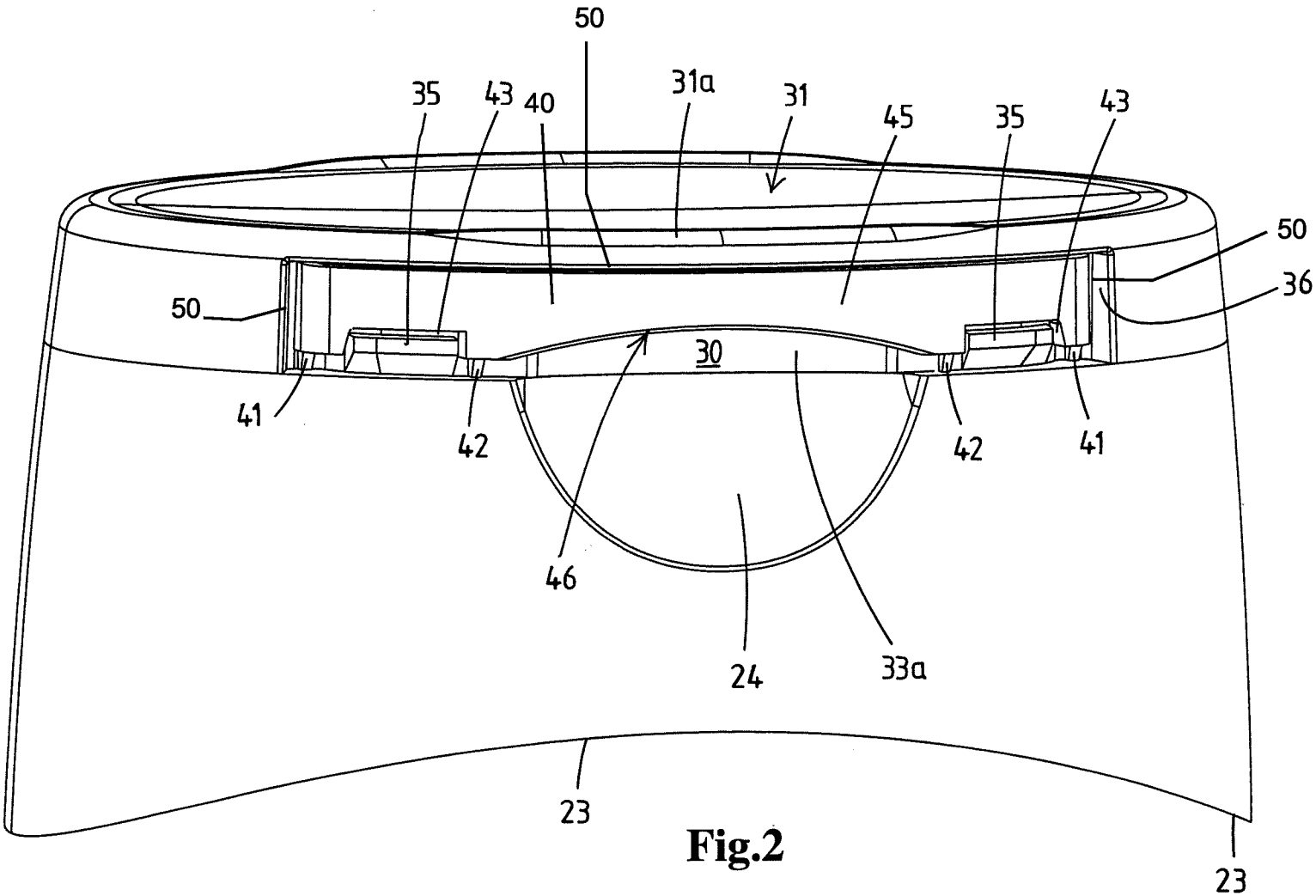
FIG. 2 shows another view in perspective of the closure of FIG. 1 in a closed state.

FIG. 1 shows a tamper-evident closure 1 which includes a closure body 2 and a pivotable lid 3 which is connected to the body 2 by means of a hinge 4, in particular a film hinge, which is well known in the art. The pivotable lid 3 can be moved from an open position, which is shown in FIG. 1, to a closed position, which is shown in FIG. 2, and vice versa.

The body 2 has a top wall 21 and a peripheral wall 22 that extends from the top wall downwards. The peripheral wall 22 has a free lower end 23 which defines an open end of the closure body 2. The body 2 can be placed on top of a container (not shown) with this open end of the body 2. The container may contain a substance, like foodstuffs such as ketchup, mayonnaise, mustard or other sauces, or like cosmetic products such as shampoo, bathing products, skin treatment products, etc. The top wall 21 has a dispensing passage 25, in this case defined by an upwardly extending collar 26, through which the substance can be dispensed from the container.

The lid 3 has a cover wall 31 and a skirt 32 that in this specific embodiment is a circumferential wall that for the most part extends along the circumference of the cover wall 31 and protrudes downwards. At a front side of the closure 1 in the closed state (cf. FIGS. 2 and 3) a recess 30 is formed. The skirt 32 has a recessed skirt portion 33 that is located at a distance from the circumferential edge 34 of the cover wall 31, thereby creating an overhanging cover wall portion 31*a*. The recess 30 that is defined amongst others by the recessed skirt portion 33 has lateral walls 36 that connect the recessed portion 33 to the other part of the skirt 32. The recessed skirt portion 33 has a concave centre portion 33*a* joined at each end thereof by a convex portion 33*b*. The convex portion 33*b* is connected to the associated lateral wall 36 by means of a curved wall portion 33*c*. Thus, the recess 30 may be mainly formed in the pivotable lid 3 as an indent 33*d* in the recessed skirt portion 33 of the pivotable lid 3.

On the closure body 2 is arranged a tamper-evident strip 40. The tamper-evident strip 40 is connected with, in this case, four frangible connection points 41, 42 to the closure body 2. In particular, the connection points 41, 42 connect the underside of the tamper-evident strip 40 with a shoulder 27 of the closure body 2.

Figure 3:
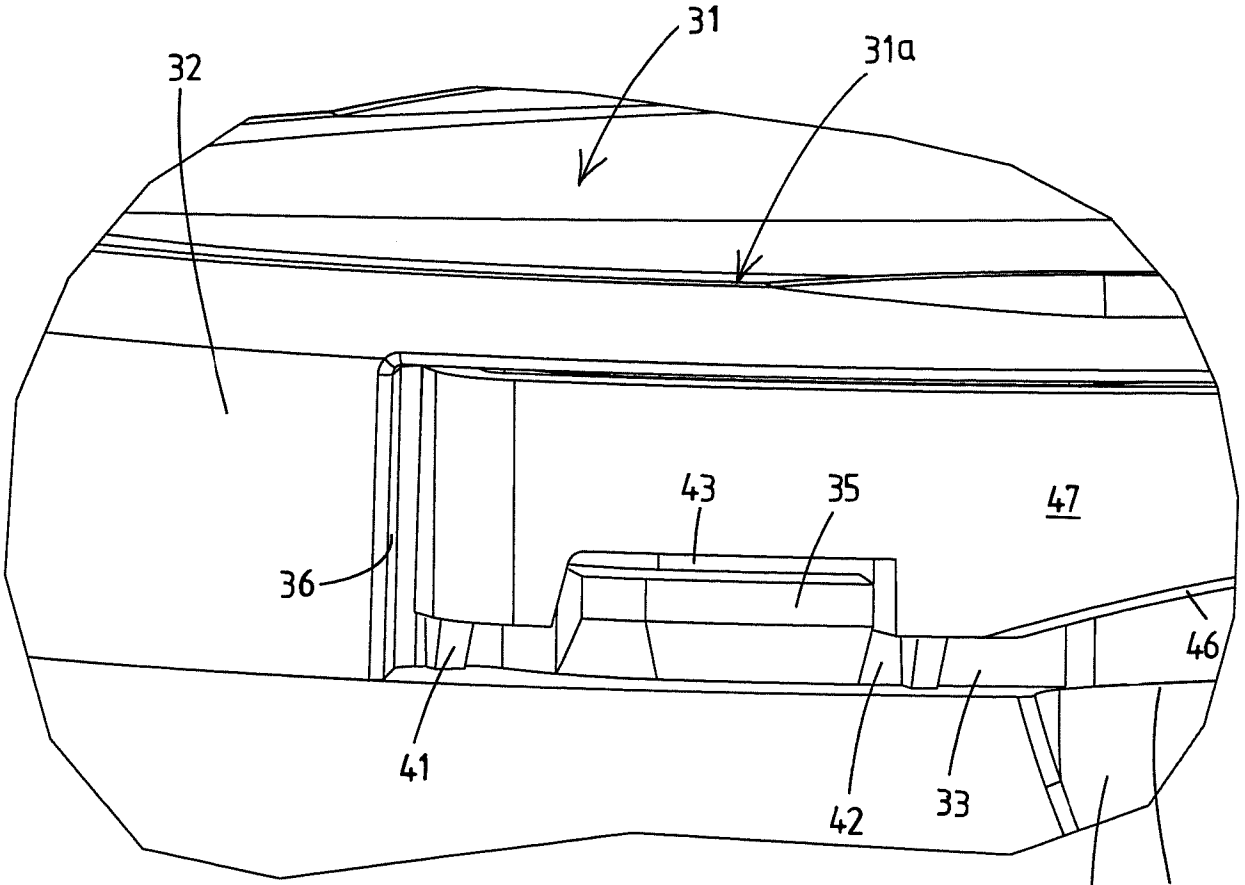
FIG. 3 shows a detail of the closure of FIG. 2.

When the lid 3 is in the closed position, which is shown in FIG. 2, the recessed skirt portion 33 of the skirt 32 is located behind the tamper-evident strip 40, seen from the outside. On the recessed skirt portion 33 two locking lugs 35 are provided that protrude from the outer skirt surface towards the outside. The tamper-evident strip 40 is provided with cutouts 43 in which the locking lugs 35 are received in the closed position of the lid 3, as can be seen in FIGS. 2 and 3. Thus the cooperation between the locking lugs 35 and the tamper-evident strip 40 prevents the lid 3 to be moved to an open position. The tamper-evident strip 40 lies countersunk within the recess 30 with a front surface 47 thereof lying flush with the portion of the skirt 32 adjacent the recess 30 and the circumferential wall 22 of the body 2. Only a small gap 50 between the outer contour 33*e* of the recess 30 and the tamper-evident strip 40 is present.

The cover wall 31 of the lid 3 overlies the tamper-evident strip 40 closely from above at the location of the recess 30, as can be seen in FIGS. 2 and 3. Preferably, cover wall 31 engages the upper side of the tamper-evident strip 40 such that it is unreachable or at least virtually unreachable from above.

The tamper-evident strip 40 has bended end portions 44 at each end. The bent portions 44 are bent inwards towards the recessed skirt portion 33. At the end of the bent portions 44 the already mentioned frangible connection points 41 are provided. In this way the virtual straight line between these two outer frangible connection points 41 lies behind the virtual straight line between the more forward frangible connection points 42, seen from the outside. Thereby it is prevented that the tamper-evident strip 40 is tilted forward, without the outer connection points 41 being broken. The bent portions 44 lie substantially parallel and close to the lateral wall 36 of the recess 30.

Preferably the angle between the tangent at the centre of the curved tamper evident strip 4 at the front surface thereof and the tangent at the bent portions 44 is in a range of 80°-100°, most preferably around 90°.

In the peripheral wall 22 of the closure body 2 an indent 24 is provided. The indent 24 is located just below a centre portion 45 of the tamper-evident strip 40 and adjoins the recess 30. The upper edge 24*a* of the indent 24 lies flush with the concave centre portion 33*a* of the skirt portion 33. The indent 24 provides space for a finger to be placed under the tamper-evident strip 40 such that it can be pulled upwards with the finger. At the centre portion 45 of the tamper-evident strip 40 a concavely curved edge 46 may be provided, facing the indent 24, where the finger can engage the strip 40.

When the closure 1 is first opened, the user grips the tamper-evident strip 40 from below at the centre portion 45 with a finger and pulls the strip 40 upwards, that is, in a direction parallel to the centre axis of the closure 1. The connection points 41 and 42 are thereby subjected to a pull force in their which causes them eventually to break. The strip 40 will then push the lid 3 at the overhanging portion 31*a* of the cover wall 31 upwards, whereby the lid 3 swivels to an open position (cf. FIG. 1). Thus while opening the closure 1 for the first time, the removal of the tamper-evident strip 40 and the opening of the lid 3 takes place in one movement.

In the embodiment shown in the drawings, the closure body 2 and the lid 3 have a substantially oval circumference. It should be understood that this is not a limiting feature. The circumference could have any other shape that is suitable for placement on a container, e.g. circular, polygonal, rectangular.

The invention claimed is:

1. A tamper-evident dispensing closure comprising:

a body adapted to be attached to a container, said body having a peripheral wall and a top wall which extends over one end of the peripheral wall, such that the corresponding end of the body is closed off by the top wall and an opposite end of the body is open, said top wall being provided with a dispensing passage;

a pivotable lid, which is hingedly attached to the body, said pivotable lid being pivotable between a closed position, in which the pivotable lid is positioned over said dispensing passage, and an open position, in which said pivotable lid is spaced apart from said dispensing passage, the pivotable lid having a cover wall and a skirt portion that extends from the cover wall, such that in the closed position of the pivotable lid, the cover wall is substantially parallel to the top wall of the body and the skirt portion engages the top wall of the body with an end remote from the cover wall;

a tamper-evident strip located within the contour of the body and attached to the body by means of predetermined frangible connecting points, said tamper-evident strip being engaged or engageable by at least one locking member provided on said skirt portion of the pivotable lid, such that the pivotable lid is only pivotable to the open position when the tamper-evident strip is permanently removed by breaking the frangible connecting points;

wherein the body and the pivotable lid in the closed position define a recess in which the tamper-evident strip is received in a countersunk manner, said recess having an outer contour being defined on an upper side of the recess by the cover wall of the pivotable lid and on a lower side of the recess by the top wall of the body, and on lateral side ends of the recess by lateral wall portions adjoining the top wall of the body or the cover wall of the pivotable lid;

wherein at the outer contour of the recess a gap between the cover wall and an upper side of the tamper-evident strip is present, as well as between the lateral wall portions and the lateral side ends of the tamper-evident strip, said gap being small such that edges of the tamper-evident strip are unreachable with a user's finger; and wherein the body is provided with an indent, which adjoins the recess on the lower side thereof, and which allows a user to engage the tamper-evident strip from below with a finger so as to pull the tamper-evident strip and the pivotable lid up in one movement, during a first-time opening of the tamper-evident dispensing closure.

2. The tamper-evident dispensing closure according to claim 1, wherein the tamper-evident strip has end portions which are bent inwards.

3. The tamper-evident dispensing closure according to claim 2, wherein at least at each of said end portions a frangible connection point is arranged.

4. The tamper evident dispensing closure according to claim 1, wherein the cover wall of the pivotable lid engages an upper edge of the tamper-evident strip.

5. The tamper-evident dispensing closure according to claim 1, wherein the tamper-evident strip is attached to the body by two pairs of frangible connection points, and wherein a locking member engages a lower edge of the tamper-evident strip in between each pair of frangible connection points.

6. The tamper-evident dispensing closure according to claim 5, wherein a cutout is provided between each pair of the frangible connection points of the tamper-evident strip for receiving said locking member.

7. The tamper-evident dispensing closure according to claim 1, wherein the recess is mainly formed in the pivotable lid, as another indent in a skirt portion of the pivotable lid.

8. The tamper-evident dispensing closure according to claim 1, wherein a portion of the skirt portion of the pivotable lid has a closed contour.

9. The tamper-evident dispensing closure according to claim 8, wherein in the closed position of the pivotable lid, the skirt of the pivotable lid and the peripheral wall of the body are flush with each other, except at the location of the recess.

10. The tamper-evident dispensing closure according to claim 9, wherein the tamper-evident strip has a front surface which lies flush with the adjacent portion of the skirt of the pivotable lid and the peripheral wall of the body.

11. The tamper-evident dispensing closure according to claim 1, wherein the body, the pivotable lid and the tamper-evident strip of the tamper-evident dispensing closure are manufactured in one piece by injection moulding.

12. The tamper-evident dispensing closure according to claim 1, wherein the outer contour of the peripheral wall is curved, and wherein the tamper-evident strip extends along the contour about an angle of less than 180°.

13. A tamper-evident dispensing closure comprising:

a body adapted to be attached to a container, said body having a peripheral wall and a top wall which extends over one end of the peripheral wall, such that the corresponding end of the body is closed off by the top wall and an opposite end of the body is open, said top wall being provided with a dispensing passage;

a pivotable lid, which is hingedly attached to the body, said pivotable lid being pivotable between a closed position, in which the pivotable lid is positioned over said dispensing passage, and an open position, in which said pivotable lid is spaced apart from said dispensing passage, the pivotable lid having a cover wall and a skirt portion that extends from the cover wall, such that in the closed position of the pivotable lid, the cover wall is substantially parallel to the top wall of the body and the skirt portion engages the top wall of the body with an end remote from the cover wall;

a tamper-evident strip located within the contour of the body and attached to the body by means of predetermined frangible connecting points, said tamper-evident strip being engaged or engageable by at least one locking member provided on said skirt portion of the pivotable lid, such that the pivotable lid is only pivotable to the open position when the tamper-evident strip is permanently removed by breaking the frangible connecting points;

wherein the body and the pivotable lid in the closed position define a recess in which the tamper-evident strip is received in a countersunk manner, said recess having an outer contour being defined on an upper side by the cover wall of the pivotable lid and on an lower side by the top wall of the body, and on lateral side ends by lateral wall portions adjoining the top wall of the body or the cover wall of the pivotable lid; and wherein the tamper-evident strip has end portions which are bent inwards; and wherein the body is provided with an indent, which adjoins the recess on the lower side thereof, and which allows a user to engage the tamper-evident strip from below with a finger so as to pull the tamper-evident strip and the pivotable lid up in one movement, during a first-time opening of the tamper-evident dispensing closure.

14. The tamper-evident dispensing closure according to claim 13, wherein at least at each of said end portions of the tamper evident strip a frangible connection point is arranged.

15. A tamper-evident dispensing closure comprising:

a body with an oval circumference, adapted to be attached to a container, said body having a peripheral wall and a top wall which extends over one end of the peripheral wall, such that the corresponding end of the body is closed off by the top wall and an opposite end of the body is open, said top wall being provided with a dispensing passage;

a pivotable lid with an oval circumference, which is hingedly attached to the body, said pivotable lid being pivotable between a closed position, in which the lid is positioned over said dispensing passage, and an open position, in which said pivotable lid is spaced apart from said dispensing passage, the pivotable lid having a cover wall and a skirt portion that extends from the cover wall, such that in the closed position of the pivotable lid, the cover wall is substantially parallel to the top wall of the body and the skirt portion engages the top wall of the body with an end remote from the cover wall;

a tamper-evident strip located within the contour of the body and attached to the body by means of predetermined frangible connecting points, said tamper-evident strip extending substantially parallel to the major axis of the oval circumference, said tamper-evident strip being engaged or engageable by at least one locking member provided on said skirt portion of the pivotable lid, such that the pivotable lid is only pivotable to the open position when the tamper-evident strip is permanently removed by breaking the frangible connecting points;

wherein the body and the pivotable lid in the closed position define a recess in which the tamper-evident strip is received in a countersunk manner, said recess having an outer contour being defined on an upper side of the recess by the cover wall of the lid and on an lower side of the recess by the top wall of the body, and on lateral side ends of the recess by lateral wall portions adjoining the top wall of the body or the cover wall of the pivotable lid; and wherein the tamper-evident strip has end portions which are bent inwards, wherein at least at each of said end portions of the tamper evident strip a frangible connection point is arranged; and wherein the body is provided with an indent, which adjoins the recess on the lower side thereof, and which allows a user to engage the tamper-evident strip from below with a finger so as to pull the tamper-evident strip and the pivotable lid up in one movement, during a first-time opening of the tamper-evident dispensing closure.

* * * * *